US008137155B2

(12) United States Patent
Horii et al.

(10) Patent No.: US 8,137,155 B2
(45) Date of Patent: Mar. 20, 2012

(54) CLOTHING HAVING CUPS

(75) Inventors: Katsuko Horii, Kyoto (JP); Kiriko Kondo, Kyoto (JP); Saori Sakamoto, Kyoto (JP)

(73) Assignee: Wacoal Corp., Kyoto (JP)

( * ) Notice: Subject to any disclaimer, the term of this patent is extended or adjusted under 35 U.S.C. 154(b) by 512 days.

(21) Appl. No.: 12/402,532

(22) Filed: Mar. 12, 2009

(65) Prior Publication Data

US 2009/0239445 A1 Sep. 24, 2009

(30) Foreign Application Priority Data

Mar. 19, 2008 (JP) ..... 2008-072185

(51) Int. Cl.
*A41D 3/00* (2006.01)
*A41C 3/00* (2006.01)

(52) U.S. Cl. ..... 450/75; 450/59

(58) Field of Classification Search ..... 450/31, 450/59–62, 70, 74–76, 78
See application file for complete search history.

(56) References Cited

U.S. PATENT DOCUMENTS 3,165,045 A * 1/1965 Troll ..... 396/551
5,045,019 A * 9/1991 Capasso et al. ..... 450/74
5,167,566 A * 12/1992 Novitsky et al. ..... 450/74
5,385,502 A * 1/1995 Moretz et al. ..... 450/93
6,685,534 B2 * 2/2004 Mitchell et al. ..... 450/74
6,918,812 B2 * 7/2005 Giese ..... 450/65
7,435,155 B2 * 10/2008 Reinisch et al. ..... 450/59

FOREIGN PATENT DOCUMENTS

JP 3016829 U 7/1995
JP 10-60708 A 3/1998

OTHER PUBLICATIONS

English language Abstract of JP 10-60708 A, Mar. 3, 1998.

* cited by examiner

*Primary Examiner* — Gloria Hale

(74) *Attorney, Agent, or Firm* — Greenblum & Bernstein, P.L.C.

(57) ABSTRACT

Clothing having cups in which a front center supporting part is provided at a portion where front sides of left and right cups covering left and right breasts respectively which are disposed nearer to a front center in a left-to-right direction than top portions of the left and right cups are continuous with each other, with a front central position interposed between the front sides of the left and right cups. Upper and lower portions of the front center supporting part are spread in a left-to-right direction with the upper and lower portions thereof extended to upper and lower sides of the left and right cups respectively surrounding each of the top portions to such an extent that the upper portion is located at a position where the upper portion and a strap are continuous with each other.

5 Claims, 10 Drawing Sheets

[Prior Art]

[Prior Art]

STANDING POSTURE

POSTURE OF LYING ON THE BACK

POSTURE OF LYING ON THE SIDE

CLOTHING HAVING CUPS

This nonprovisional application claims priority under 35 U.S.C. §119(a) on Patent Application No(s). 2008-072185 filed in Japan on Mar. 19, 2008, the entire contents of which are hereby incorporated by reference.

BACKGROUND OF THE INVENTION

1. Field of the Invention

The present invention relates to clothing such as a brassiere having cups and the like and more particularly to a brassiere having cups which stably holds breasts without making a user feel tight and oppressed while the user is in a lying posture while they are asleep.

2. Description of the Related Art

Most women remove the brassiere from their breasts while they are asleep and wear it in the daytime when they are awake. A questionnaire made for a large number of women has revealed that women who wear the brassiere while they are asleep is about 30%, whereas women who do not wear the brassiere while they are asleep is about 70%.

As a result of the questionnaire, it has been found that as the reason why they do not wear the brassiere while they are asleep, "They do not want to feel tight and oppressed." "They want their breasts to have rest while they are asleep." But the following problems occur when they do not wear the brassiere while they are asleep: "The breasts get out of shape." "When they turn, the breasts shake." "When they lie on the side, left and right breasts contact each other, which is troublesome."

It has been also found that as the reason why they wear the brassiere while they are asleep, "They wear the brassiere to prevent their breasts from hanging down and getting out of shape". "Unless they wear the brassiere, the breasts move and are unstable and thus they are nervous." But the following problems occur when they wear the brassiere while they are asleep, "They feel that the lower portion of the brassiere fits the bust very closely." "The wire of the brassiere contacts the skin, which makes them feel uncomfortable."

Most of brassieres commercially available are designed based on a standing posture. Ordinary brassieres are so constructed that the breasts are lifted in the standing posture and gathered forward to keep the outlook of the breasts beautiful. That is, a wire is mounted on the brassiere at portions corresponding to the lower edge of the contour of the breasts and to the left and right side edges thereof in the standing posture to support the breasts so that the breasts do not hang down but are directed upward and gathered forward to prevent the breasts from moving to the user's armpits. In addition, the under cup piece is pulled toward the rear side of the brassiere by a fastener attached to the rear surface thereof to place the left and right cups in position.

The ordinary brassiere is not intended to be worn while the user is asleep. Therefore while the user is asleep, she feels tight and oppressed.

As a brassiere which well-shapes the breasts without pressing the entire breasts and makes a user comfortable, as shown in FIG. 8, the brassiere not having a wire mounted thereon was proposed, as disclosed in registered Japanese Utility Model Application No. 3016829 (patent document 1). The cup 1 is provided with the lift cloth 2 made of the approximately crescent moon-shaped power net at the inner side thereof. Only the lower side portion 2*a* of the lift cloth 2 is sewed to the lower edge of the cup 1 and the edge of the side thereof, whereas the upper side portion 2*b* of the lift cloth 2 is afloat from the inner surface of the cup 1 with the upper side portion 2*b* spanning the upper surface of the cup 1.

As shown in FIG. 9, disclosed in Japanese Patent Application Laid-Open No. 10-60708 (patent document 2) is the flexible bust cup, for holding the breasts, which has the function of well-shaping the breasts and makes a user comfortable. The bust cup 8 is composed of a stretchable material. The bust cup 8 is disposed in the space surrounded with the chest panel 6 which contacts the upper portion of the breasts and the under-panel 7 disposed below the breasts, with the bust cup 8 joined with the chest panel 6 and under-panel 7. The cup 8 is joined with the chest panel 6 by butt seaming J of the folded ridge lines 6L and 8L of these panels. Thereby it is possible to remove uncomfortableness that is given to the user by the portion where the cup and the outer cloth are joined with each other and make her feel comfortable.

Patent document 1: Japanese Utility Model Application No. 3016829

Patent document 2: Japanese Patent Application Laid-Open No. 10-60708

However, the shapes of the breasts in the posture of lying on the back and the posture of lying on the side during sleep are greatly different from the shapes of the breasts in the standing posture. Thus the volume of the breasts in the above-described lying postures offsets from the volume thereof in the standing posture. More specifically, as shown in FIG. 10A, the breasts are directed downward by gravity in the standing posture, whereas in the posture of lying on the back, the left and right breasts move to the armpits and spread with the left and right breasts sunken at the front side thereof and shift upward from the position thereof in the standing posture, as shown in FIG. 10B. As a result, the contour of the breasts in the posture of lying on the back spread to the armpits and upward (toward the neck) than the contour of the breasts in the standing posture. As shown in FIG. 10C, in the posture of lying on the side, the left and right breasts shift upward (toward the neck) from the position thereof in the standing posture with the left and right breasts shifting downward from the posture of lying on the back by gravity, with the upper portions of the left and right breasts sunken. Thus the volume of the breasts in the posture of lying on the side offset to a high extent from the volume thereof in the standing posture.

Similarly to the conventional brassiere, the brassieres shown in FIGS. 8 and 9 are so constructed that based on the breasts in the standing posture, the left and right breasts are drawn toward the center of the left and right cups respectively. Therefore when the user wears the brassieres shown in FIGS. 8 and 9 during sleep, the cups are incapable of following the offset of the volume and accommodating the breasts therein. Therefore the brassieres are incapable of stably supporting the breasts, thus making the user oppressed and tight to a high extent.

The breast that is large in under-breast, namely, the circumference of the lower portion thereof and the breast having a large cup size are offset to a high extent in the volume thereof in the posture of lying on the side shown in FIG. 10C. Thus the brassiere is incapable of holding the breasts therein. Consequently the front central portions of the left and right cups separate from the breasts with an inner verge line of the upper-side breast B2 shown by a dotted line in FIG. 10C projects from the cup. Thus the breasts get out of shape in the posture of lying on the side and are unstable. Thereby a load is applied to the bottom portions of the breasts. Because European and American women have large-cup size breasts at a higher rate than Japanese women, the above-described tendency is conspicuous in the European and American women.

Clothing having cups that is suitably used during sleep to support large-cup size breasts has not been provided. Women wearing a brassiere having a large size cup feel uneasy about losing of the shape of their breasts. Thus there is a strong demand for the development of clothing having cups capable of stably supporting the breasts in the posture of lying on the side during sleep.

SUMMARY OF THE INVENTION

The present invention has been made to solve the above-described problems. Therefore it is an object of the present invention to provide clothing having cups such as a brassiere which does not make a user feel tight and oppressed while she is asleep in wearing it and is capable of stably supporting the breasts having a large cup size by preventing the breasts from moving out of the cup.

To achieve the object of the present invention, the present invention provides clothing having cups in which a front center supporting part is provided at a portion where front sides of left and right cups having full-cup shapes to cover left and right breasts respectively which are disposed nearer to a front center in a left-to-right direction than top portions of the left and right cups are continuous with each other, with a front central position interposed between the front sides of the left and right cups; upper and lower portions of the front center supporting part are spread in a left-to-right direction with the upper and lower portions thereof extended to upper and lower sides of the left and right cups respectively surrounding each of the top portions to such an extent that the upper portion is located at a position where the upper portion and a strap are continuous with each other; a cup central weak supporting part having a lower holding force than the front center supporting part is formed at a central portion of each of the left and right cups covering the top portion with the cup central weak supporting part continuous with the front center supporting part; and the cup central weak supporting part is more stretchable than the front center supporting part.

In the present invention, "clothing having cups" means "clothing having a pair of cups". As described above, the front center supporting part is disposed at the portion where the front sides of the left and right cups disposed nearer to the front center of the left and right cups in the left-to-right direction thereof than the top portions of the left and right cups are continuous with each other, with the front central position interposed between the front sides of the left and right cups. As described above, the front sides of the left and right cups are continuously disposed at the front center of the left and right cups to form the front center supporting part so that the left and right breasts are held not by a base part, with the left and right breasts disposed at a distance. Thereby it is possible to prevent the front center of the left and right cups from separating from the breasts. Therefore the upper cup joins with the inner verge line of the upper breast to a high extent in a posture of lying on the side.

In the present invention, the left and right cups covering the left and right breasts are full cup-shaped. The upper and lower portions of the front center supporting part are spread in the left-to-right direction of the left and right cups, with the upper and lower portions of the front center supporting part extended to the upper and lower sides of the left and right cups respectively surrounding the top portion. Therefore it is possible to support the well-developed breasts in such a way that the breasts are wrapped by vectors of forces acting in two directions from both upper and lower sides of the cup toward the center thereof. For example, the center supporting part is insufficient for lifting the breasts with a vector acting in one direction from the upper side of the cup toward the center thereof. Therefore the upper cup joins with the inner verge line of the upper breast to a low extent in the posture of lying on the side.

The breasts move upward (toward the neck) in the posture of lying on the side. The upper portion of the front center supporting part is spread in the left-to-right direction of the left and right cups with the upper end of the front center supporting part located at a position where the upper end of the front center supporting part and the strap are continuous with each other. Thereby it is possible to prevent the movement of the upper base portion of each of the left and right breasts. Further the lower portion of the front center supporting part is also spread in the left-to-right direction of the left and right cups. Thereby it is possible to hold the lower base portion of each of the left and right breasts without moving the lower base portion of each of the left and right breasts.

As described above, the clothing having this construction stably holds the well-developed breasts without applying burden to the base portion thereof and restrains the change of the form thereof while a user is sleeping. Therefore the user having well-developed breasts can be released from worrying about the collapse thereof.

In addition to the formation of the center supporting part vertically integral, the center supporting part may be disposed upward from the front central position to the upper side of the cup continuous with the strap and downward from the front central position to the lower side thereof continuous with the base part.

In this case, it is preferable to set the tightening force of the upper side of the center supporting part and the tightening force of the lower side thereof almost equally to each other. From the standpoint of keeping the shape of the breasts, it is preferable to set the tightening force of the upper side of the center supporting part larger than the tightening force of the lower side thereof. But in this case, the upper side of the center supporting part supports the breasts to a low extent in the posture of lying on the side, and there is a fear that the upper side of the center supporting part presses the shoulder to a high extent in a standing posture.

The cup central weak supporting part having a lower holding force than the front center supporting part is formed at the central portion of each of the left and right cups covering the top portion with the cup central weak supporting part continuous with the front center supporting part. The cup central weak supporting part is more stretchable than the front center supporting part. Because the central portion of each of the left and right cups has a low holding force and is stretchable, the left and right cups are capable of accommodating therein the breasts that have moved to the neighborhood of the top portion thereof with the breasts held by the front center supporting part. Further the central portion of each of the breasts is capable of moving freely to some extent without being given a sense of oppression. Thereby the user feels that the user does not wear the brassiere and is given a sense of relief and thus feels relaxed.

It is preferable that the left and right cups are formed in a region defined by a front center line passing through the front central position and by a contour formed along an edge of each of the left and right breasts which spreads toward an armpit side of each of the left and right cups in a posture of lying on the back; and; gathers are formed at a front central region of the front center supporting part. Thereby the front center supporting part imparts a breast-supporting force to the breasts such that in a posture of lying on the side, the left and right cups do not overlap each other with the front central region interposed between the left and right cups.

The lower edge of the left and right cups and an edge of the armpit thereof are defined by the contour formed along the left and right breasts which spread to the armpit side in the posture of lying on the back. Portions of the brassiere surrounded with the contour and the front central position are formed as the left and right cups. In the present invention, the configuration of the cup in the posture of lying on the back and that of the cup in the standing posture are different from each other. Thereby in the posture of lying on the back, the breasts can be stably held in the posture of lying on the back by preventing the base portion of each of the left and right breasts from moving inside the cup.

The gathers are formed at the front central region of the front center supporting part. Owing to the formation of the gathers, the upper cup is capable of joining with the inner verge line of the upper breast to a high extent in the posture of lying on the side. Further it is possible to increase the breast-supporting force of the center supporting part. Thus it is possible to prevent the left and right cups from overlapping each other.

It is preferable that a cup armpit-side supporting part is provided at an armpit-side portion, of each of the left and right cups, which is continuous with the cup central weak supporting part; and an armpit-side weak supporting part is provided in a region from the cup armpit-side supporting part to a contour disposed at the armpit-side portion of each of the left and right cups.

By providing the left and right cups with the cup armpit-side supporting part, it is possible to gather the breasts which have moved to the armpit side toward the center of each of the left and right cups and hold the base portion of each of the left and right breasts to prevent the movement the base portion thereof.

According to experiments conducted by the present inventors, it has been found that the base portion of each of the left and right breasts which have moved to the armpit side of each of the left and right cups in the posture of lying on the back can be effectively restrained by only supporting one point of each of the breasts at the armpit side of each of the left and right cups in the neighborhood of the top (nipple) of each of the breasts toward the front central region of the front center supporting part. Therefore it is favorable to form the cup armpit-side supporting part at one or more portions of the armpit side of the cup. To support the breasts more stably, it is favorable to form the cup armpit-side supporting part in the shape of a belt with the upper end thereof extended to the end of the armpit side of the cup and the lower end thereof connected to the lower side of the front center supporting part. It is also favorable to connect the upper end of the cup armpit-side supporting part to the upper side of the front center supporting part to surround the center weak supporting part with the front center supporting part and the cup armpit-side supporting part.

The armpit-side weak supporting part having a low holding force than the cup armpit-side supporting part is disposed in the region from the cup armpit-side supporting part to the contour at the armpit side of the cup to decrease a sense of oppression and a pressing force thereof. Thereby the tightening force of the armpit-side weak supporting part is low to allow the breasts to be freely movable to some extent.

It is preferable that an upper portion of the front center supporting part is extended to form a wide front-side strap part; the front-side strap part is continuous with a rear-side strap part disposed at a rear side of the clothing; and the rear-side strap part is continuous with a rear supporting part continuous with left and right side edges of a front-side base part; and a wire is not mounted on a periphery of the left and right cups.

In the above-described construction, the clothing having cups of the present invention does not press portions of the body including the breast, the armpit, and the shoulder with which the clothing having the cup contacts. Thus even though the user sleeps in the clothing having the cup, the clothing having the cup does not physiologically affect the user and does not make the user feel tight and oppressed but makes the user feel comfortable and relaxed. Thus the user can sleep soundly.

The clothing having cups of the present invention such as the brassiere may be formed from cloth consisting of fabric or woven fabric having a high stretchability or formed from fabric so knitted as to change the stretchability thereof as described later.

In forming the clothing having cups such as the brassiere from cloth, to change the breast-supporting force thereof, it is possible to form the main body of the clothing from one piece of cloth, mount a supporting cloth on each of the supporting parts, or join the supporting parts and the weak supporting parts with each other.

It is preferable that the cup central weak supporting part and the armpit-side weak supporting part are formed from one piece of stretchable fabric having a low tightening force; and each of the front center supporting part, the cup armpit-side supporting part, the rear supporting part, and the base part is formed from two pieces of the stretchable fabric layered one upon another.

The reason the center supporting part, the cup armpit-side supporting part, the rear supporting part, and the base part are formed from two pieces of the stretchable fabric layered one upon another is because by setting the tightening force of each of the supporting parts to the tightening force obtained by the combination of two pieces of the stretchable fabric, it is possible to obtain the stability in holding the breasts and the comfortableness in wearing the clothing in a favorable balance. When the tightening forces of the supporting parts are set high, it is possible to improve the performance of holding the shape of the breasts. But the clothing makes the user feel tight during sleep. Thus there is a fear that the clothing prevents the user from sleeping soundly.

On the other hand, the cup central weak supporting part and the armpit-side weak supporting part are formed from one piece of cloth having a high stretchability so that the cup central weak supporting part and the armpit-side weak supporting part fit the breasts in a loosely state without pressing the breasts supported by the supporting parts.

The clothing having cups of the present invention such as the brassiere may be formed from fabric so knitted as to change the stretchability thereof. In this case, the tightening forces of some parts are set high, whereas those of other parts are set low by making the knitted texture of some parts close or by changing knitting yarn. For example, the tightening force of the supporting part such as the center supporting part is set higher than the tightening force of the weak supporting part such as the cup central weak supporting part. Formation of the clothing such as the brassiere from the knitted fabric necessitates only knitting to be performed. Thus it is possible to easily form the clothing such as the brassiere and delicately differentiate the degree of the strength of the breast-supporting force.

The clothing having cups of the present invention can be preferably used as brassieres to be worn during sleep and in practicing a sport and a brassiere for juniors. The brassiere of the present invention can be most suitably used during sleep.

The clothing having cups of the present invention can be especially preferably used for users having a large under-breast size and a large cup size (in each cup size, not less than C80, D80, E75, E80, F75, G70, G75) when they sleep.

The rear surface of the brassiere of the present invention is continuous so that the user puts on the brassiere by slipping it over her head. It is preferable that a metal fitting consisting of a fastener is not mounted on the rear surface of the brassiere.

It is preferable not to use metal parts such as the fastener not to make the user feel uncomfortable. Therefore the rear surface of the brassiere is continuous so that the user puts on the brassiere by slipping it over her head.

The clothing having cups of the present invention can be preferably used as a brassiere-provided slip, a brassiere-provided shirt, brassiere-provided pajamas, a brassiere-provided swimming wear, a brassiere-provided leotard, and a brassiere-provided T-shirt for outer use.

Mounting of the brassiere on pajamas eliminates the need for wearing the brassiere under the pajamas and is capable of restraining the breasts from moving without pressing the breasts, thus making the user feel easy in wearing the brassiere-provided pajamas.

Mounting of the brassiere on a tank top or a T-shirt eliminates the need for wearing the brassiere in summer and does not make the user feel sultry, thus allowing the user to wear the tank top or the T-shirt refreshingly.

As apparent from the foregoing description, in the clothing having cups of the present invention, the front sides of the left and right cups are continuously disposed at the front center of the left and right cups to form the front center supporting part so that the left and right breasts are held not by the base part, with the left and right breasts disposed at a distance. Thereby it is possible to prevent the front center of the left and right cups from separating from the breasts. Therefore the upper cup joins with the inner verge line of the upper breast to a high extent in the posture of lying on the side. Further the front center supporting part is extended to the upper and lower sides of the left and right cups respectively surrounding the top portion thereof. Therefore it is possible to support the well-developed breasts in such a way that the breasts are wrapped by vectors of forces acting in two directions from both upper and lower sides of cup toward the center thereof. Furthermore the cup central weak supporting part is stretchable and thus allows the breasts to freely move and deform to some extent. Therefore the left and right cups are capable of stably supporting the well-developed upper breast, and thus allowing the user to sleep relaxedly and soundly without the breasts getting out of shape and without the user feeling tight and oppressed. Therefore the brassiere is optimum in wearing it when the user sleeps. The left and right cups are capable of stably supporting the base portion of the breasts surrounding the top thereof by preventing the movement and deformation of the base portion thereof. Therefore the brassiere is reliable because the breasts do not get out of shape in wearing it and capable of preventing the left and right cups from contacting each other and the user from feeling oppressed or oppressively warm while the user is asleep.

EXPLANATION OF REFERENCE NUMERAL AND SYMBOLS

Figure 1:
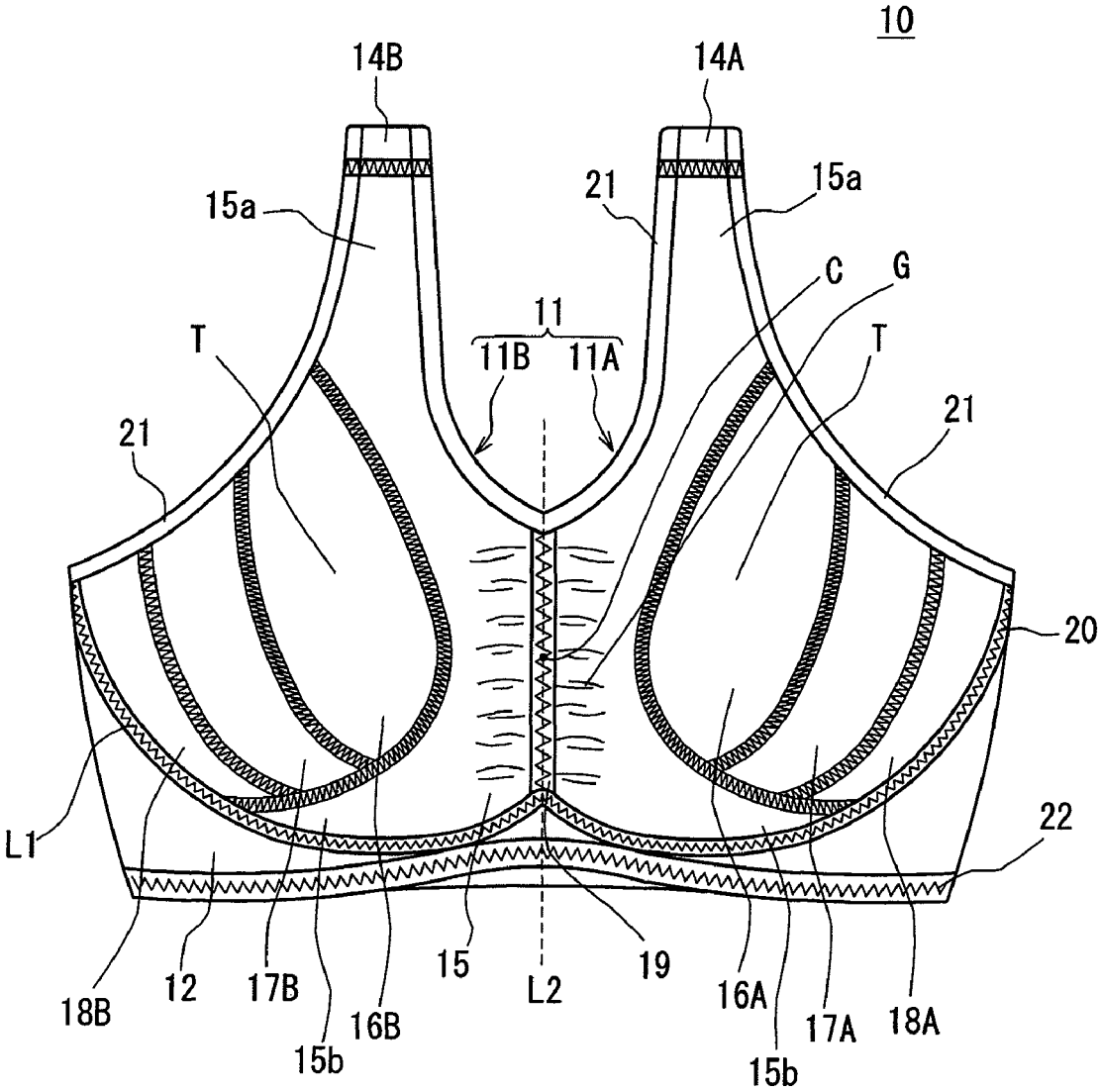
FIG. 1 is a rear view of a front side of a brassiere of a first embodiment of the present invention.

10 brassiere
11 cup
12 base cloth
13 rear supporting cloth
14 strap cloth
15 front center supporting cloth
16 cup central weak supporting cloth
17 cup armpit-side supporting cloth
18 armpit-side weak supporting cloth
40 tank top
L1 contour
L2 front center line

DETAILED DESCRIPTION OF THE PREFERRED EMBODIMENTS

The embodiments of the present invention are described below with reference to the drawings.

Figure 2A:
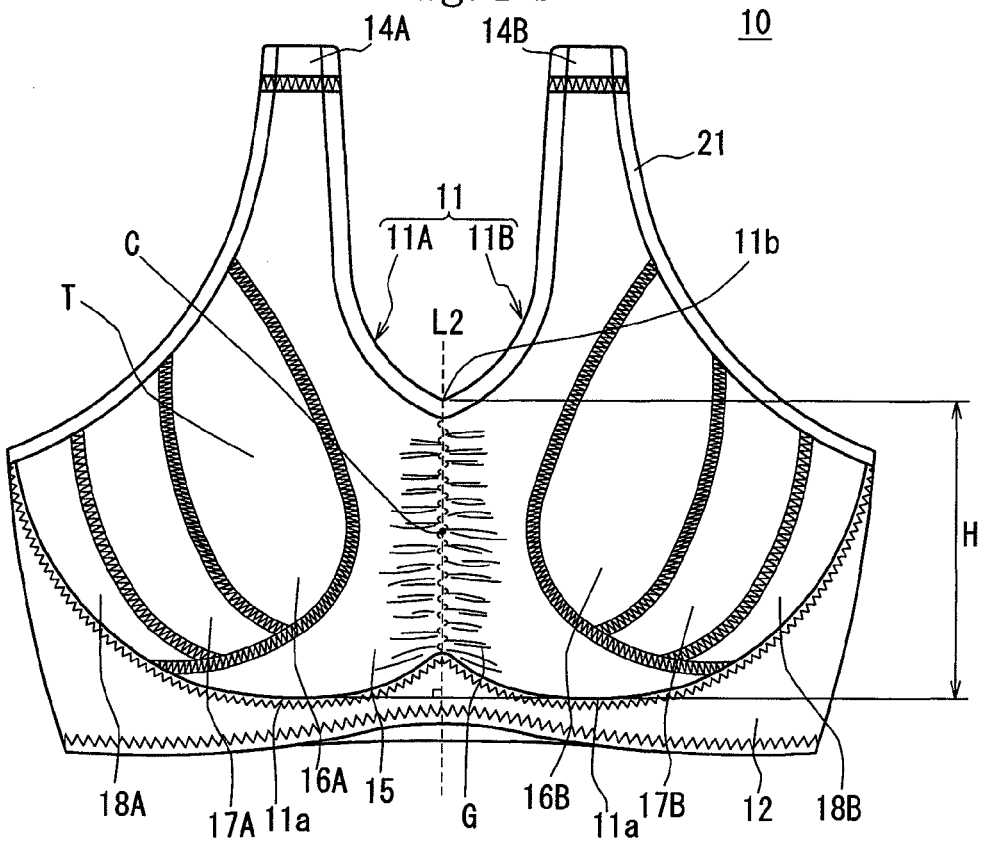
FIG. 2A is a front view of the brassiere shown in FIG. 1 seen from the front side thereof.
Figure 2B:
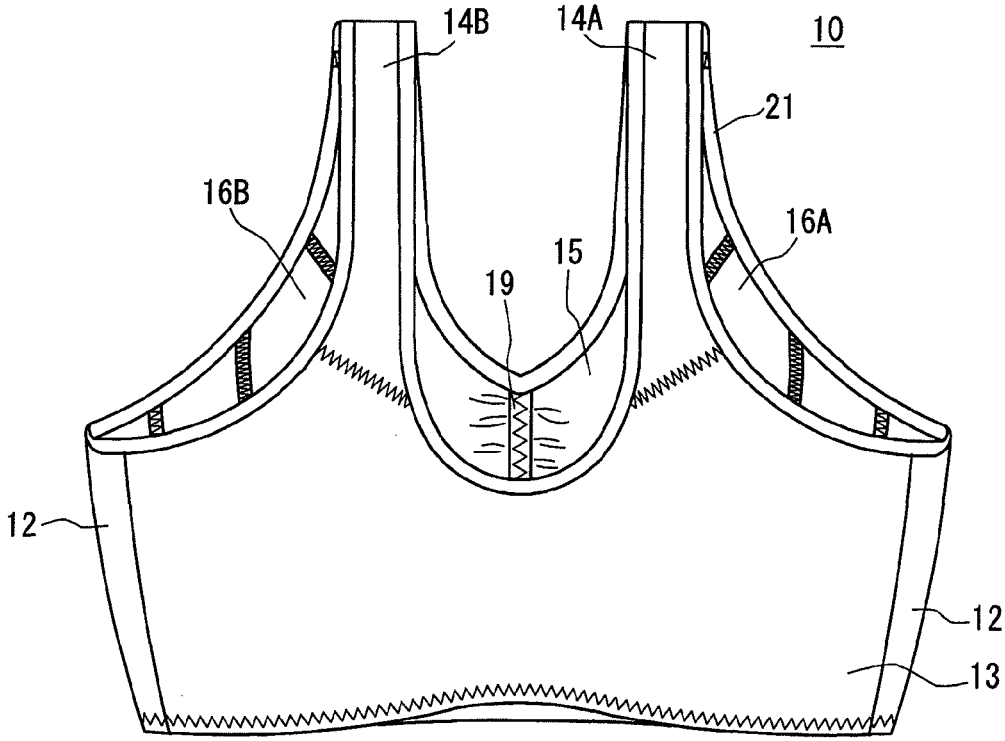
FIG. 2B is a front view of the brassiere shown in FIG. 1 seen from the rear side thereof.

FIGS. 1 and 2 show a brassiere 10 of a first embodiment of the present invention. The brassiere 10 is made of stretchable cloth. The brassiere 10 has a full cup configuration covering the entire breasts. A user puts on the brassiere 10 by slipping it over her head. The brassiere 10 has a front center line L2, provided vertically, which passes through a front central position C, left and right cups 11 (11A, 11B) defined by a contour L1, a base cloth 12 disposed below the left and right cups 11, a rear supporting cloth 13, and a strap cloth 14. A fringing tape 21 is sewed to portions of the brassiere 10 corresponding to the periphery of her neck and armpit.

Each of the left and right cups 11 is composed of two pieces of supporting cloths consisting of a front center supporting cloth 15 and a cup armpit-side supporting cloth 17 and two pieces of weak supporting cloths consisting of a cup central weak supporting cloth 16 and an armpit-side weak supporting cloth 18. The cup 11 is divided into the left cup portion 11A and the right cup portion 11*b* at a front center of the front center supporting cloth 15.

The base cloth 12, the rear supporting cloth 13, the strap cloth 14; and the front center supporting cloth 15, the cup central weak supporting cloth 16, the cup armpit-side supporting cloth 17, and the armpit-side weak supporting cloth 18 composing the left and right cups 11 are made of the same cloth weak in its tightening force, favorable in its stretchability, and favorable in its air permeability. In this embodiment, plain knitted fabric with a bare polyurethane yarn is used for these cloths.

The weak supporting cloths (the cup central weak supporting cloth 16 and the armpit-side weak supporting cloth 18) composing the left and right cups 11 are formed from one piece of cloth respectively. The strap cloth 14 is also formed from one piece of cloth. The supporting cloths (the front center supporting cloth 15 and the cup armpit-side supporting cloth 17) composing the left and right cups 11 are formed from two pieces of cloth. The base cloth 12 and the rear supporting cloth 13 are also formed from two pieces of cloth respectively.

In detail, the front center supporting cloth 15 is mounted at a portion where the front sides of the left and right cups 11 disposed nearer to the front center than the top portion T (top position of breast) of the left and right cups 11 are continuous with each other, with the front central position C interposed between the front sides of the left and right cups 11. An upper portion 15*a* of the front center supporting cloth 15 and a lower portion 15*b* thereof are spread in the left-to-right direction of the brassiere 10 with the upper portion 15*a* and the lower portion 15*b* extended to an upper side and a lower side of each of the left and right cups 11 respectively surrounding the top portion T to such an extent that the upper portion 15*a* is located at the position where the upper portion 15*a* and the strap cloth 14 are continuous with each other.

A stretchable tape 19 is mounted on a rear surface along the front center line L2 of the front center supporting cloth 15. Gathers G are formed on the front surface of the front center supporting cloth 15 along the front center line L2.

A vertical length H showing a shortest distance between a straight line connecting lowermost ends 11*a* of the left and right cup portions 11A, 11B to each other and an uppermost end 11*b* of the front center line L2 passing through the front central position C is set to 11 to 17 cm.

The uppermost end lib of the front center line L2 is located at a position spaced at 9 to 12 cm from the lowermost end of her neck. In a wearing test conducted by using a monitor, the position spaced at 9 to 12 cm from the lowermost end of her neck corresponds to a position which covers the fourth breast bone but does not reach the third breast bone.

The cup central weak supporting cloth 16 (16A, 16B) is sewed to the front center supporting cloth 15 to dispose the cup central weak supporting cloth 16 continuously with the front center supporting cloth 15 at the central portion of each of the left and right cups 11A,11B covering the top portion T. The cup armpit-side supporting cloth 17 (17A, 17B) is mounted on an armpit-side portion of the cup 11 continuous with the cup central weak supporting cloths 16A, 16B. The armpit-side weak supporting cloth 18 (18A, 18B) is disposed in a region from the cup armpit-side supporting cloth 17 to the contour L1 disposed at the armpit side of the cup 11.

Figure 10A:
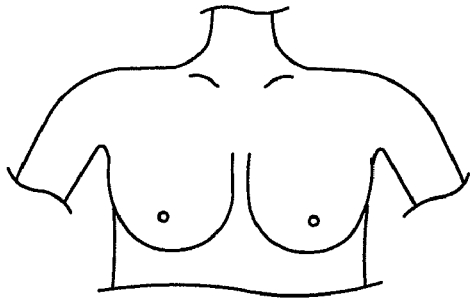
FIG. 10A shows the state of breasts in a standing posture.
Figure 10B:
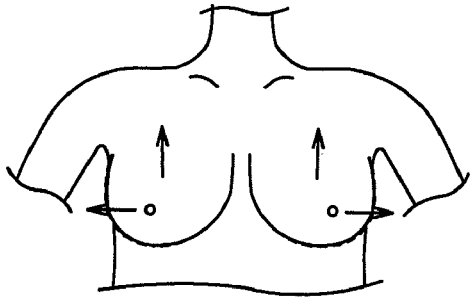
FIG. 10B shows the state of the breasts in a posture of lying on the back.

The contour L1 disposed at the armpit side of each of the left and right cups 11 and the lower end thereof at which the base cloth 12 and the left and right cups 11 are sewed to each other is so disposed as to extend along the contour of the breasts in a posture of lying on the back shown with the dotted line in FIG. 10B. The contour in the posture of lying on the back spreads to the armpit side of each of the left and right cups 11 and the upward side (toward the neck) to a higher extent than the contour in a standing posture. The contour L1 also spreads to the upward side in the posture of lying on the side.

Ordinary brassieres have a wire mounted thereon from the lower edge of the contour to the left and right side edges of the cup in the standing posture. On the other hand, the brassiere 10 of the first embodiment does not have the wire mounted thereon, but has a stretchable tape cloth 20 mounted thereon.

The rear supporting cloth 13 is not separate at the center of the rear surface thereof, but is continuous. The left and right ends of the rear supporting cloth 13 are sewed to the base cloth 12. A fastener is not mounted on the rear supporting cloth 13 so that the user puts on the brassiere 10 by slipping it over her head.

A stretchable tape 22 is mounted on the periphery of the lower end, of the brassiere 10, composed of the base cloth 12 and the rear supporting cloth 13.

A metal fitting for longitudinally hanging the brassiere 10 is not mounted either on the wide strap cloth 14 disposed between the rear supporting cloth 13 and the upper end of the front center supporting cloth 15.

Figure 3:
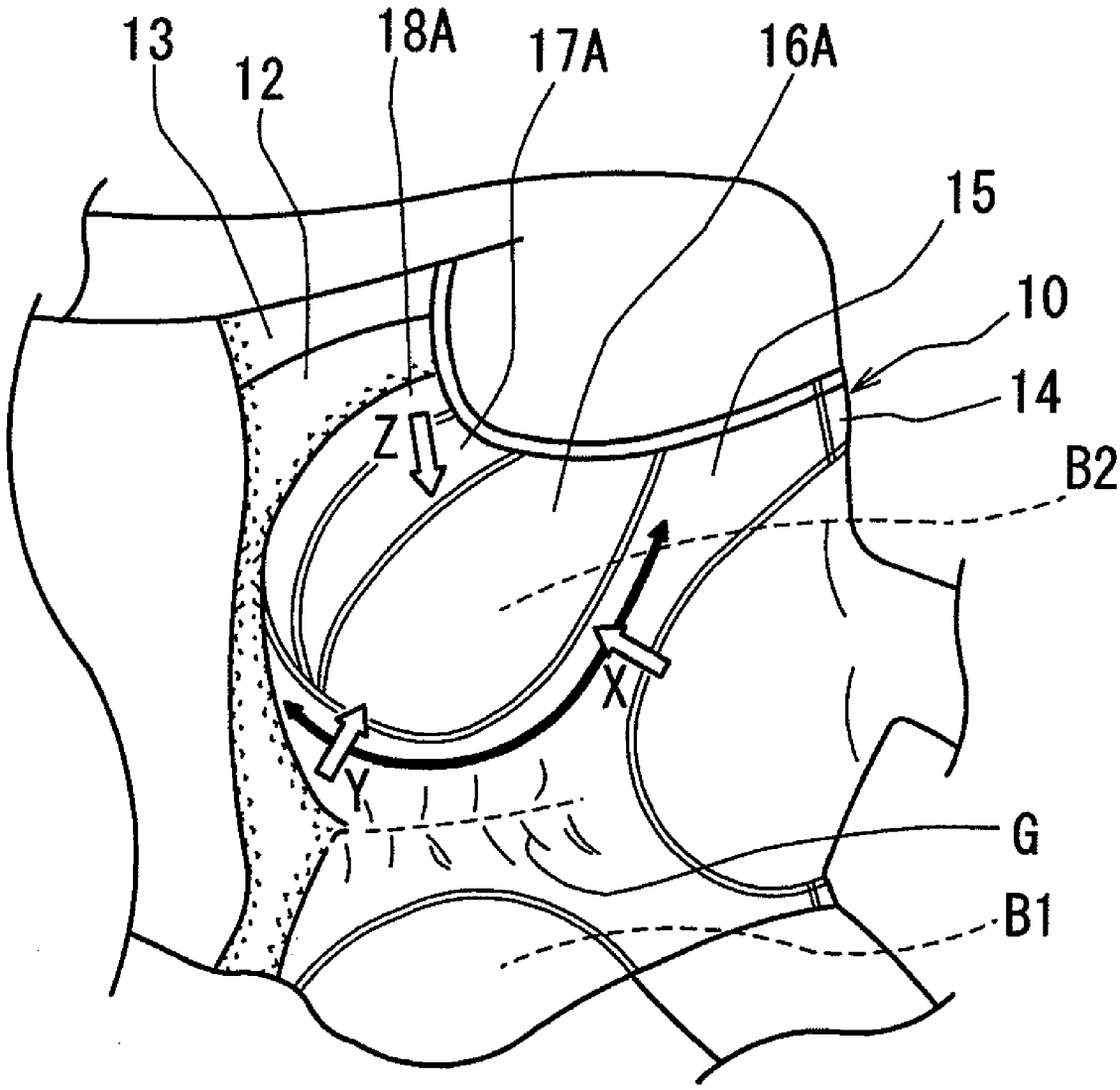
FIG. 3 is a schematic view showing the force of the brassiere for supporting breasts in posture of lying on the side.

The operation of the brassiere 10 having the above-described construction is described below with reference to FIG. 3.

Figure 10C:
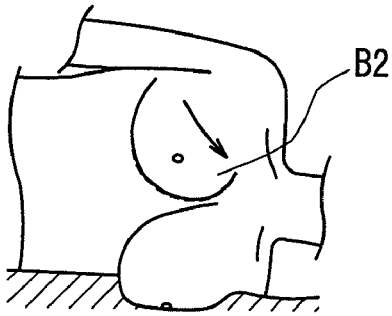
FIG. 10C shows the state of breasts in the posture of lying on the side.

When the user wearing the large cup size brassiere (in each cup size, C80, D80, E75, E80, F75, G70, G75) takes the posture of lying on the side shown in FIG. 10C, the breasts greatly offset in the volume thereof.

When the user wears the brassiere 10, the front center supporting cloth 15 fits the inner verge line of the upper breast B2 shown with the dotted line in FIG. 10C in the posture of lying on the side. Thereby the front center supporting cloth 15 is capable of supporting the upper breast B2 that has hung down by its own gravity in a large area. Because the front center supporting cloth 15 is spread in the left-to-right direction of the brassiere 10 with the upper portion 15*a* thereof and the lower portion 15*b* thereof extended to the upper side and the lower side of each of the left and right cups 11 respectively, the front center supporting cloth 15 is capable of stably supporting the well-developed upper breast B2 in two directions shown with X, Y in FIG. 3 toward the center of the cup 11 and preventing the upper breast B2 from getting out of shape. In using the conventional brassiere for supporting breasts having the large cup size, the upper breast B2 overlaps the lower breast B1, which causes the user to feel that the breasts are burdensome or heavy. On the other hand, in the brassiere 10 the front center supporting cloth 15 is capable of always holding the left and right breasts B1 and B2 at a distance owing to the breast-supporting force thereof. Further because the gathers G are formed at the front center position of the front center supporting cloth 15, the front center supporting cloth 15 fits the breasts well.

The central portion of each cup surrounding the top portion T of each breast is composed of the stretchable cup central weak supporting cloth 16 consisting of one piece of cloth having a high stretchability. Therefore the brassiere 10 does not give the user a sense of oppression of crushing the breasts and in addition allows the breasts to freely move to some extent, thus allowing the user to have a sense of relief and to be relaxed.

The position of the contour L1 forming the boundary at the armpit side of each of the left and right cups 11 and at the lower sides thereof between the base cloth 12 and the left and right cups 11 is set on the basis of the contour in the posture of lying on the back when the user is asleep. Therefore the brassiere 10 stably supports the breasts in the posture of lying on the back without moving the base portions of the breasts surrounding the top portion T. In addition, the cup armpit-side supporting cloth 17 supports the breast in a direction shown with Z in FIG. 3. Therefore even though the breasts are well-developed, a portion thereof which has moved toward the armpit side is gathered toward the center thereof. Thereby the breasts do not get out of shape, which allows the user to feel at rest.

Further the armpit-side weak supporting cloth 18 having a low tightening force is provided between the cup armpit-side supporting cloth 17 and a portion of the contour L1 disposed at the armpit side of the cup 11. Therefore the brassiere 10 allows the breasts to be moved freely to some extent to decrease a sense of oppression to be applied thereto.

As described above, the brassiere 10 is capable of stably supporting the well-developed breasts in both the posture of lying on the side and the posture of lying on the back. Thereby the brassiere 10 prevents the breasts from getting out of shape even though the user shifts sleeping positions and does not make the user feel tight and oppressed, thus allowing the user to have a good sleep. Therefore the brassiere 10 is optimum in wearing it when the user sleeps.

A fastening tool and a wire making the user feel uncomfortable are not attached to the brassiere 10. Further non-stretchable materials are not used for the brassiere 10. Therefore the brassiere 10 does not make the user feel tight and oppressed at portions of the user other than the breasts, but is capable of giving the user an easy sense of relief.

Figure 4:
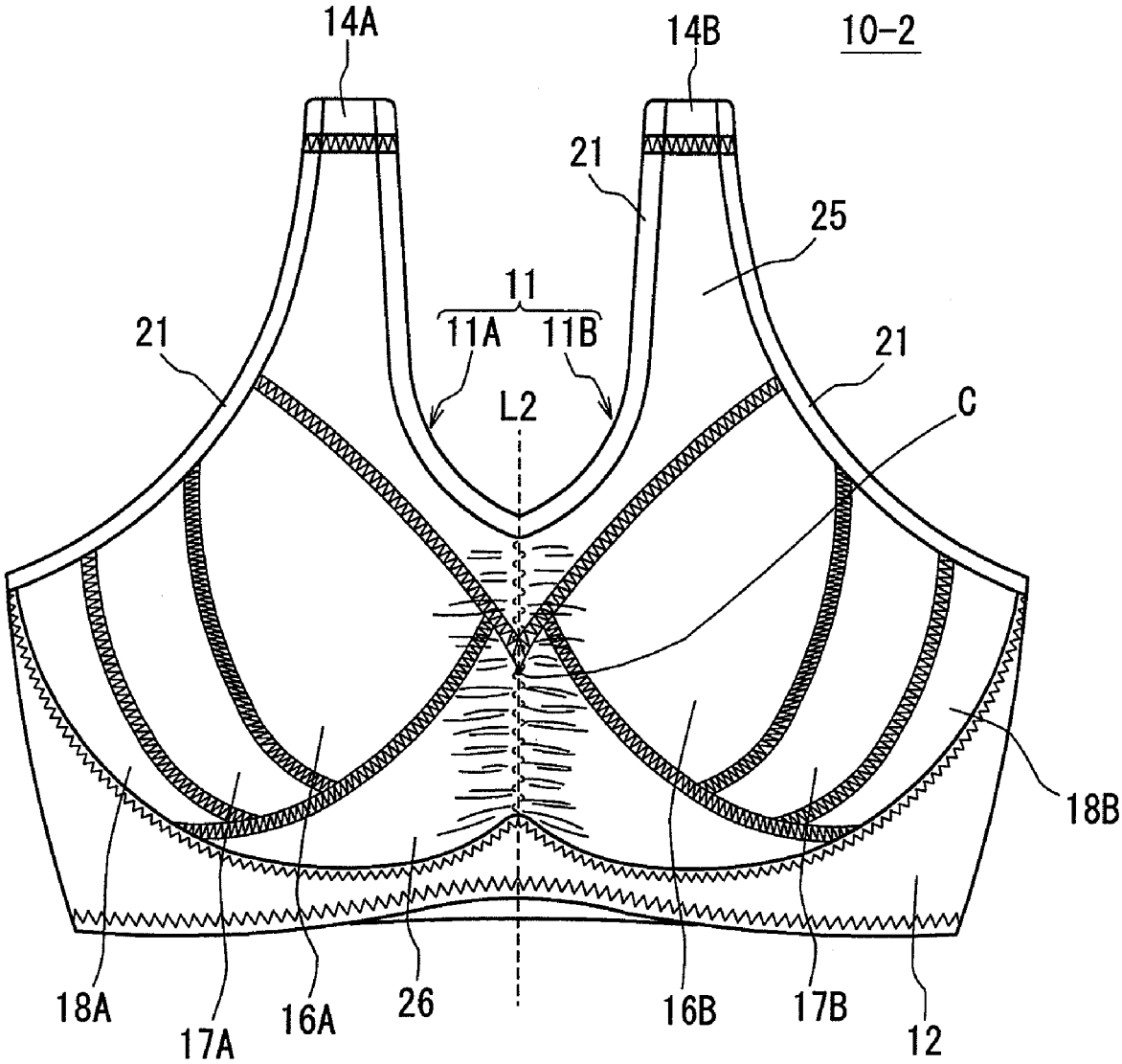
FIG. 4 is a schematic view showing a first modification of the first embodiment.

FIG. 4 shows a brassiere 10-2 of a first modification of the first embodiment of the present invention.

In the brassiere 10-2, the front center supporting cloth 15 is vertically divided into two portions at the front central position C. More specifically, the front center supporting cloth 15 is composed of an upper cloth 25 continuously formed upward from the front center of the brassiere 10-2 to the strap cloth 14 and a lower cloth 26 continuously formed downward from the front center thereof to the base cloth 12. The upper cloth 25 and the lower cloth 26 are made of the same cloth as that of the front center supporting cloth 15 and thus have a tightening force equal to that of the front center supporting cloth 15.

The brassiere 10-2 having the front center supporting cloth divided into the upper cloth 25 and the lower cloth 26 is capable of stably supporting the breasts similarly to the brassiere 10 of the first embodiment.

Figure 5:
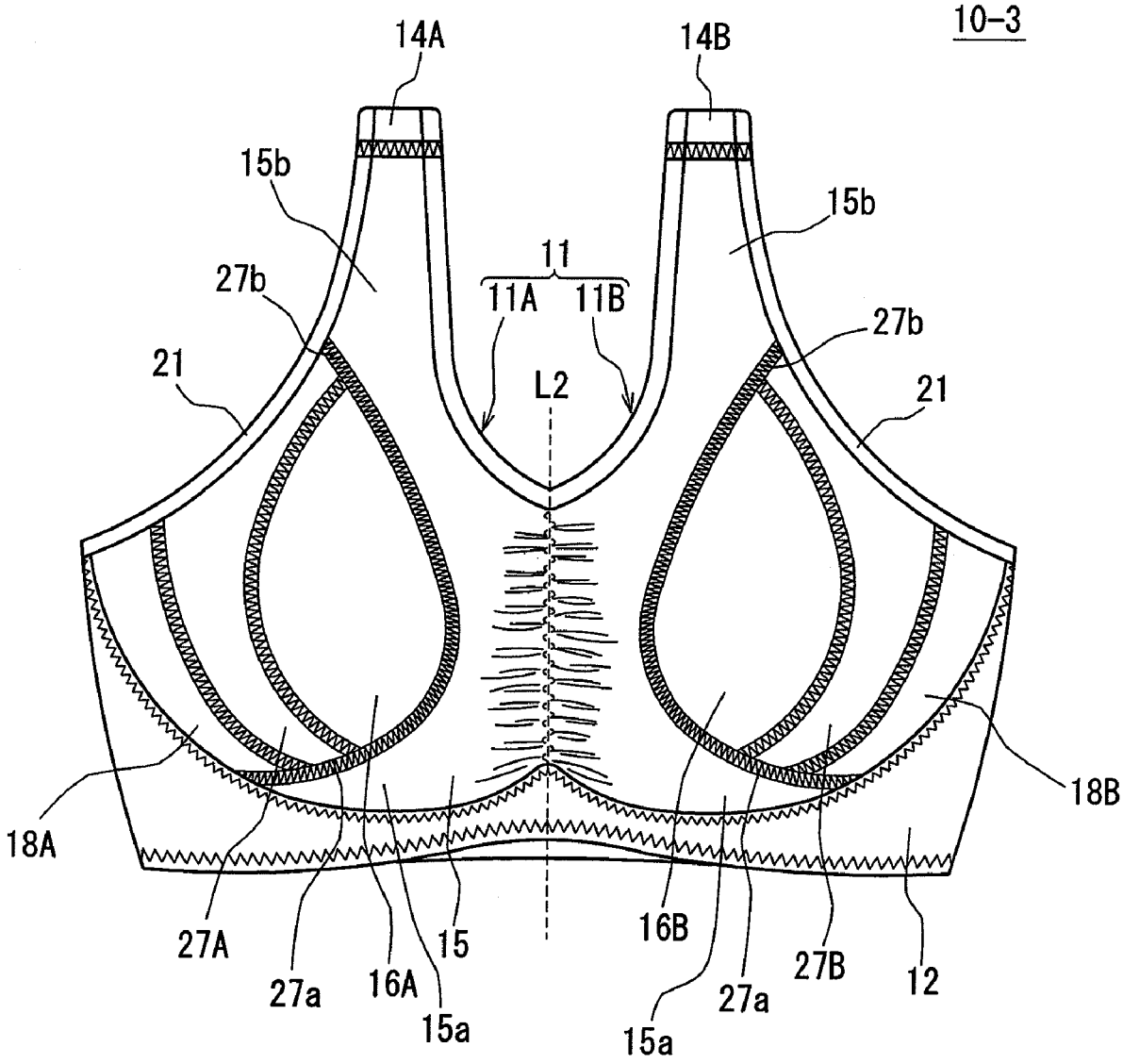
FIG. 5 is a schematic view showing a second modification of the first embodiment.

FIG. 5 shows a brassiere 10-3 of a second modification of the first embodiment of the present invention.

The cup armpit-side supporting cloth of the brassiere 10-3 is different from that of the first embodiment in its configuration.

More specifically, the second modification is similar to the first embodiment in that a lower edge 27*a* of a cup armpit-side supporting cloth 27 of the second modification is continuous with a lower portion 15*a* of the front center supporting cloth 15, but is different from the first embodiment in that an upper edge 27*b* of the cup armpit-side supporting cloth 27 is continuous with an upper portion 15*b* of the front center supporting cloth 15 to surround the left and right cup central weak supporting cloth 16 (16A, 16B) with the front center supporting cloth 15 and the cup armpit-side supporting cloth 27 (27A, 27B).

This construction is capable of improving the force of supporting the breasts which has moved toward the armpit side of the brassiere 10-3 in the posture of lying on the back.

Figure 6:
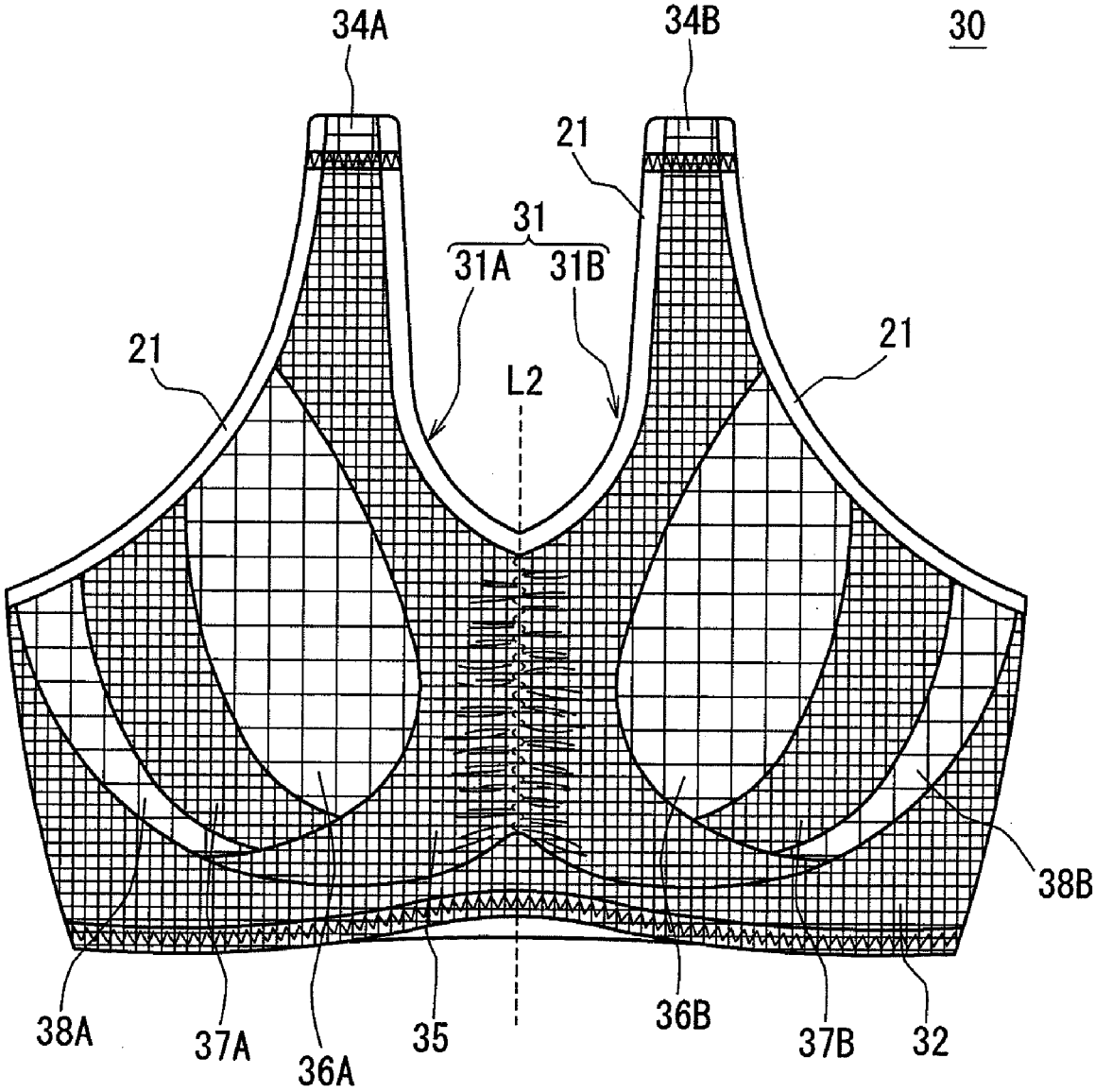
FIG. 6 is a schematic view showing a brassiere of a second embodiment of the present invention.

FIG. 6 shows a brassiere 30, composed of fabric, of a second embodiment of the present invention.

The entire configuration of the brassiere 30 is similar to that of the brassiere 10 of the first embodiment. Left and right cups 31 (31A, 31B), a base part 32, a rear supporting part (not shown in FIG. 6), and a strap part 34 are continuously formed with fabric tubularly knitted. The rear supporting part is sewed to the lower end of the rear side of the strap part 34.

Inside the left and right cups 31 of the brassiere 30, the knitted texture of a front center supporting part 35 and a cup armpit-side supporting part 37 are closer than that of a cup central weak supporting part 36 and an armpit-side weak supporting part 38 to make the tightening force of the front center supporting part 35 and that of the cup armpit-side supporting part 37 higher than that of the cup central weak supporting part 36 and that of the armpit-side weak supporting part 38. The front center supporting part 35 and the cup central weak supporting part 36 disposed at the central portion of the cup are so knitted as to bulge to some extent.

The knitted texture of the base part 32 and that of the rear supporting part have a tightening force similar to that of the front center supporting part 35 to enhance the breast-supporting force of the base part 32 and that of the rear supporting part. On the other hand, the tightening force of the strap part 34 is set low.

Other constructions of the second embodiment are similar to those of the first embodiment, and the operation and effect of the second embodiments are similar to those of the first embodiment. Thus the same parts of the second embodiment as those of the first embodiment are denoted by the same reference numerals as those of the first embodiment, and description thereof is omitted herein.

The brassieres of the first and second embodiments can be preferably used while the user is asleep. Further the brassieres do not make the user feel tight and oppressed, and restrain movements and deformations of the breasts in the left-to-right and vertical directions thereof. Therefore it is possible to use the brassieres of the first and second embodiments in practicing sports. The brassieres of the first and second embodiments are capable of restraining the breasts from moving and deforming vertically when the user takes exercise, e.g., when the user jogs. Therefore the user can take exercise without worrying about the shaking of the breasts.

The brassieres of the first and second embodiments can be preferably used for juniors.

Because juniors' breasts have not grown completely, it is necessary not to press the breasts. Further the brassiere is not demanded to have a function of raising the breasts upward and gathering them forward. If the breasts shake a little when the user takes exercise, the user wants to prevent the shaking of the breasts. The brassiere of the present invention does not press the breasts and thus does not make the user feel oppressed and is capable of restraining the breasts from moving and deforming. Thus the brassiere of the present invention can be preferably used for juniors.

Figure 7:
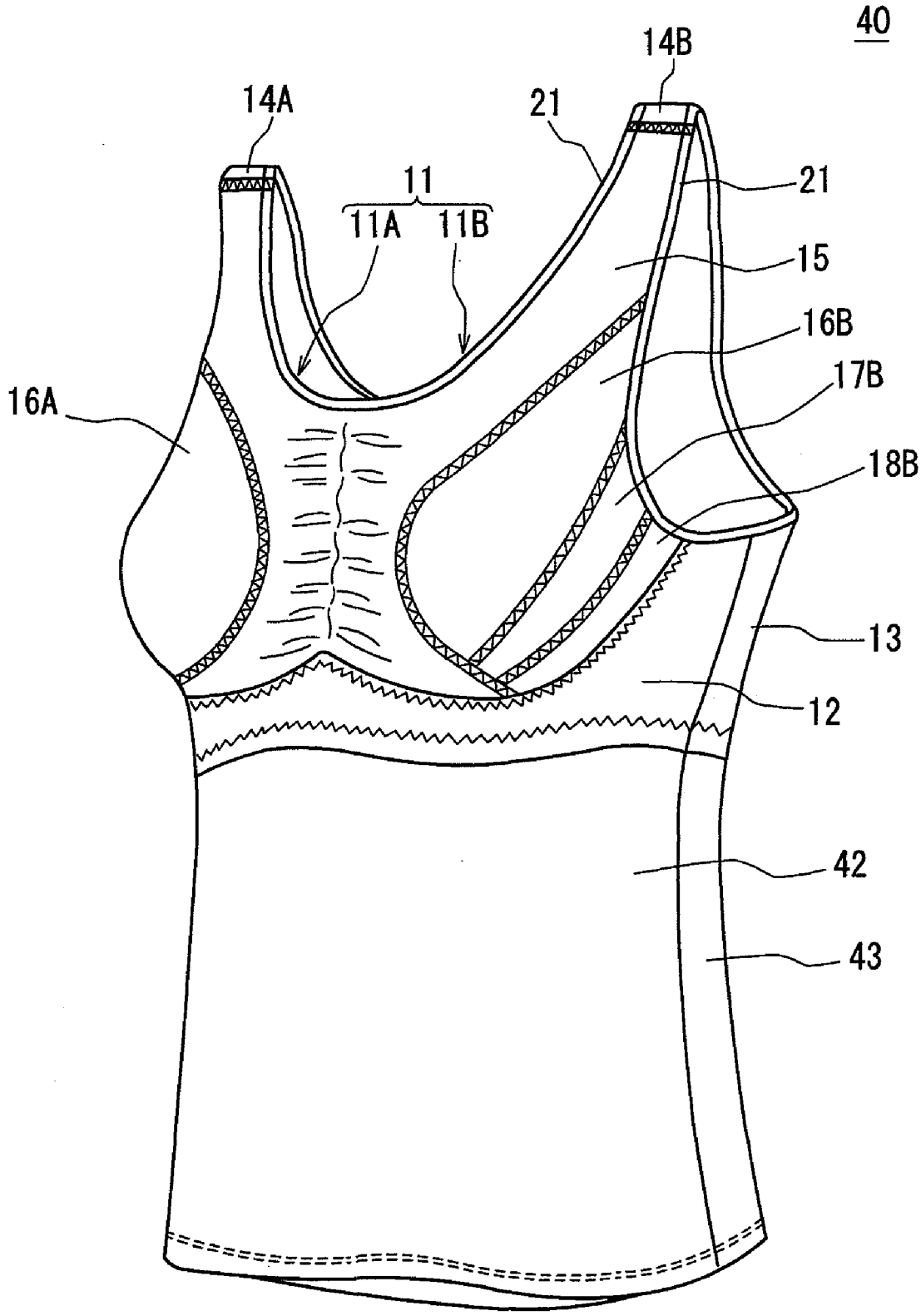
FIG. 7 is a schematic view showing a tank top of a third embodiment provided.
Figure 8:
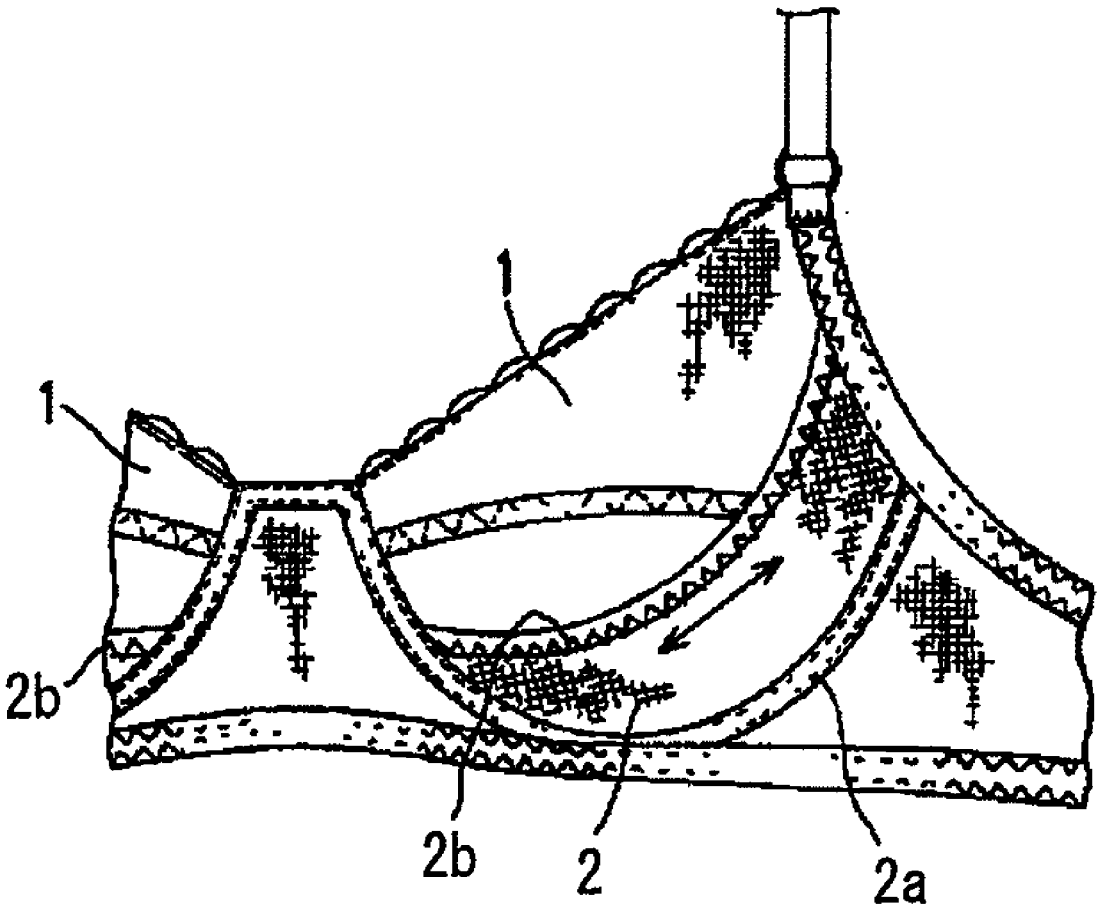
FIG. 8 shows conventional art.
Figure 9A:
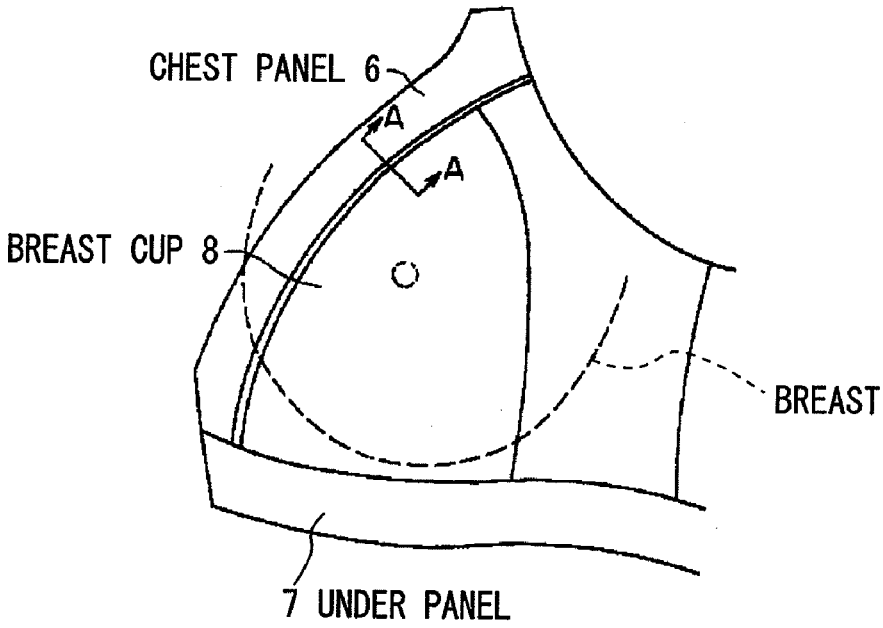
FIG. 9 shows another conventional art.
Figure 9B:
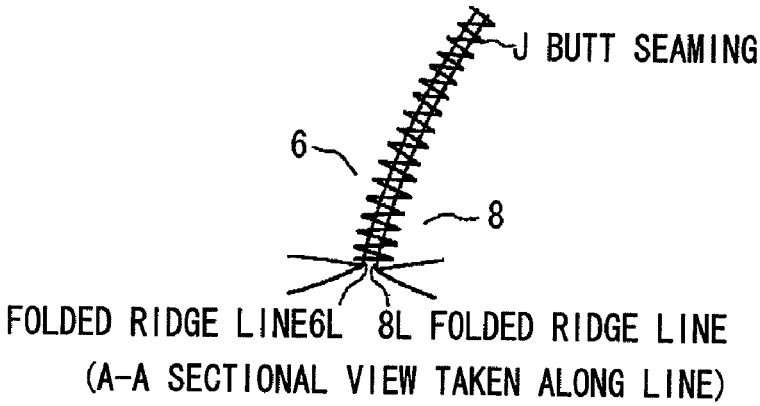
[Prior Art] Fig. 9B

FIG. 7 shows a tank top 40 of the third embodiment provided with a brassiere.

The tank top 40 is different from the brassiere 10 of the first embodiment in that in the former, a front body 42 and a rear body 43 are sewed to the base cloth 12 and the rear supporting cloth 13 respectively with the front body 42 and the rear body 43 extended downward. Each of the front body 42 and the rear body 43 is composed of one piece of cloth same as that used for other portions of the tank top 40.

Because the tank top 40 is capable of covering the belly, it is capable of preventing the belly from being cooled during sleep. Thus the tank top 40 can be preferably used as underwear during sleep.

Other constructions of the third embodiment are similar to those of the first embodiment. Thus the same parts of the third embodiment as those of the first embodiment are denoted by the same reference numerals as those of the first embodiment, and description thereof is omitted herein.

The present invention is not limited to the above-described embodiments. For example, the front center supporting cloth and the cup armpit-side supporting cloth may be continuous with each other. The brassiere may be so constructed that gathers are not formed at the front center position of the front center supporting cloth.

The rear surface cloth may be divided at the center thereof and a fastener soft to the skin may be mounted on the rear surface cloth so that the brassiere is used not by slipping it over her head, but by fastening the brassiere on the rear side thereof.

What is claimed is:

1. Clothing having cups in which a front center supporting part is provided at a portion where front sides of left and right cups having cup shapes to cover left and right breasts respectively which are disposed nearer to a front center in a left-to-right direction than top portions of said left and right cups are continuous with each other, with a front central position interposed between said front sides of said left and right cups;

upper and lower portions of said front center supporting part are spread in a left-to-right direction with said upper and lower portions thereof extended to upper and lower sides of said left and right cups respectively surrounding each of said top portions to such an extent that each said upper portion is located at a position where said upper portion and a strap are continuous with each other;

a cup central weak supporting part is formed at a central portion of each of said left and right cups covering said top portion with said cup central weak supporting part continuous with said front center supporting part;

a cup armpit-side supporting part is provided at an armpit-side portion, of each of said left and right cups, which is continuous with said cup central weak supporting part; said cup armpit-side supporting part is belt-shaped with the upper end of the cup armpit-side supporting part extending to the end of the armpit side of the cup, and the lower end of the cup armpit-side supporting part extending toward the front center and connected to the lower side of the front center supporting part; and said cup central weak supporting part is more stretchable than said front center supporting part.

2. The clothing having cups according to claim 1, wherein said left and right cups are formed in a region defined by a front center line passing through said front central position and by a contour formed along an edge of each of said left and right breasts which spreads toward an armpit side of each of said left and right cups in a posture of lying on said back; and gathers are formed at a front central region of said front center supporting part, whereby said front center supporting part imparts a breast-supporting force to said breasts such that when said wearer is in a posture of lying on said side, said left and right cups do not overlap each other with said front central region interposed between said left and right cups.

3. The clothing having cups according to claim 1, wherein an armpit-side weak supporting part is provided in a region from said cup armpit-side supporting part to a contour disposed at said armpit-side portion of each of said left and right cups.

4. The clothing having cups according to claim 1, wherein an upper portion of said front center supporting part is extended to form a wide front-side strap part; said front-side strap part is continuous with a rear-side strap part disposed at a rear side of said clothing; and said rear-side strap part is continuous with a rear supporting part continuous with left and right side edges of a front-side base part.

5. The clothing having cups according to claim 4, wherein said cup central weak supporting part and said armpit-side weak supporting part are formed from one piece of stretchable fabric having a low tightening force; and each of said front center supporting part, said cup armpit-side supporting part, said rear supporting part, and said under cup piece is formed from two pieces of said stretchable fabric layered one upon another.

* * * * *